US009700192B2

(12) United States Patent
Montefusco

(10) Patent No.: US 9,700,192 B2
(45) Date of Patent: Jul. 11, 2017

(54) ABRASIVE SPONGE AND PROCESS FOR PRODUCTION THEREOF

(71) Applicant: EUDOREX S.R.L., Acerra (IT)

(72) Inventor: Alfonso Montefusco, Acerra (IT)

(73) Assignee: EUDOREX S.R.L., Acerra (IT)

( * ) Notice: Subject to any disclaimer, the term of this patent is extended or adjusted under 35 U.S.C. 154(b) by 204 days.

(21) Appl. No.: 14/654,245

(22) PCT Filed: Dec. 20, 2013

(86) PCT No.: PCT/IT2013/000359
§ 371 (c)(1),
(2) Date: Jun. 19, 2015

(87) PCT Pub. No.: WO2014/097343
PCT Pub. Date: Jun. 26, 2014

(65) Prior Publication Data

US 2015/0305585 A1 Oct. 29, 2015

(30) Foreign Application Priority Data

Dec. 20, 2012 (IT) ..... RM2012A0652

(51) Int. Cl.
*B24D 11/00* (2006.01)
*A47L 13/16* (2006.01)
*B24D 11/02* (2006.01)

(52) U.S. Cl.
CPC ..... *A47L 13/16* (2013.01); *B24D 11/001* (2013.01); *B24D 11/02* (2013.01)

(58) Field of Classification Search
CPC ..... B24B 37/22; B24B 37/26; B24B 37/24; B24D 11/001; B24D 11/02; B24D 15/04; A47L 13/16
USPC ..... 451/532–539
See application file for complete search history.

(56) References Cited

U.S. PATENT DOCUMENTS 2,386,780 A * 10/1945 Cross ..... A47L 13/16 156/279
2,880,439 A * 4/1959 Swartz ..... A47L 13/16 15/229.11
3,267,187 A * 8/1966 Slosberg ..... B29C 43/006 264/122

(Continued)

FOREIGN PATENT DOCUMENTS

EP 0 156 160 A2 10/1985
WO WO 00/64326 A1 11/2000

OTHER PUBLICATIONS

International Search Report for Italian Patent Application No. RM2012A000652 dated Aug. 15, 2013.

(Continued)

*Primary Examiner* — George Nguyen
(74) *Attorney, Agent, or Firm* — Arent Fox LLP

(57) ABSTRACT

The present invention concerns an abrasive sponge (10) comprising a layer of spongy material (11) covered on at least one side, by a coating layer (13) for the removal of dirt, characterized in that inside said layer of spongy material (11), in the vicinity of the surface of the side covered with said coating layer (13) and in any case below such surface, a plurality of granules (12) of rigid material are present.

Figure 1:
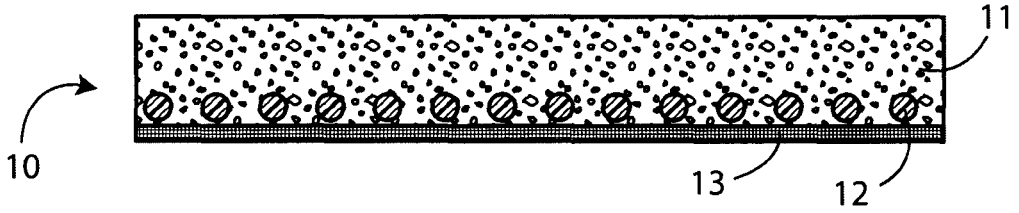
Figure 2A:
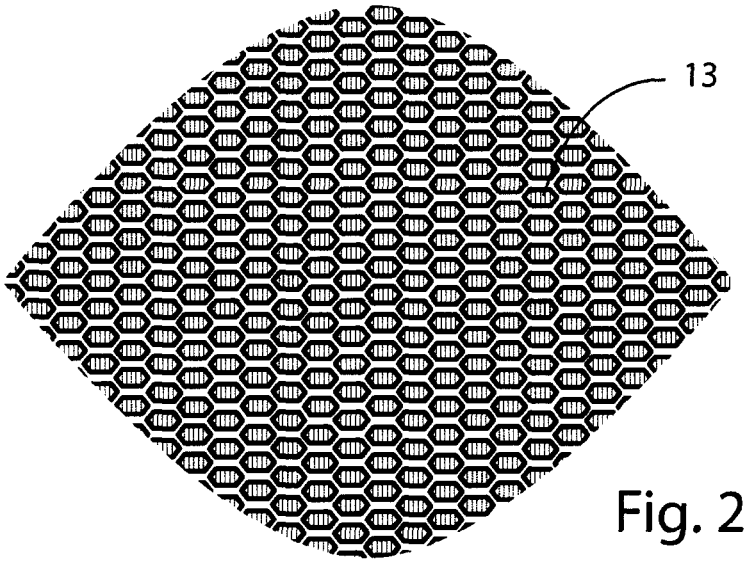
Figure 2B:
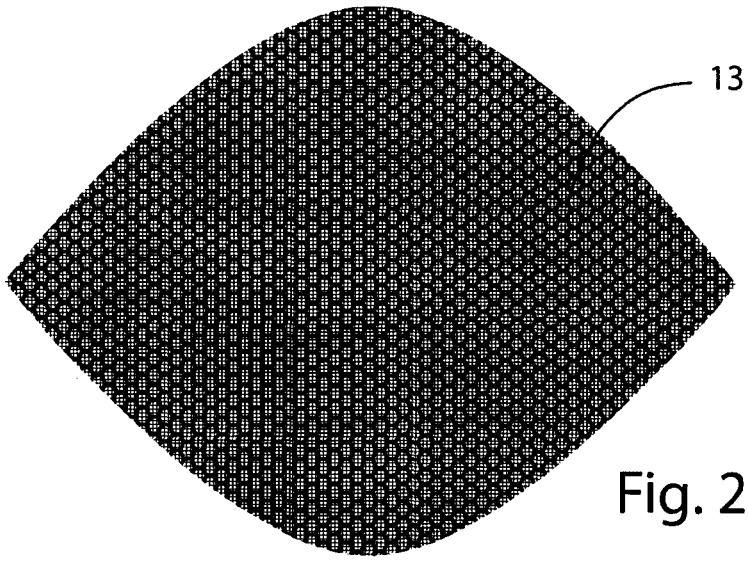
Figure 2C:
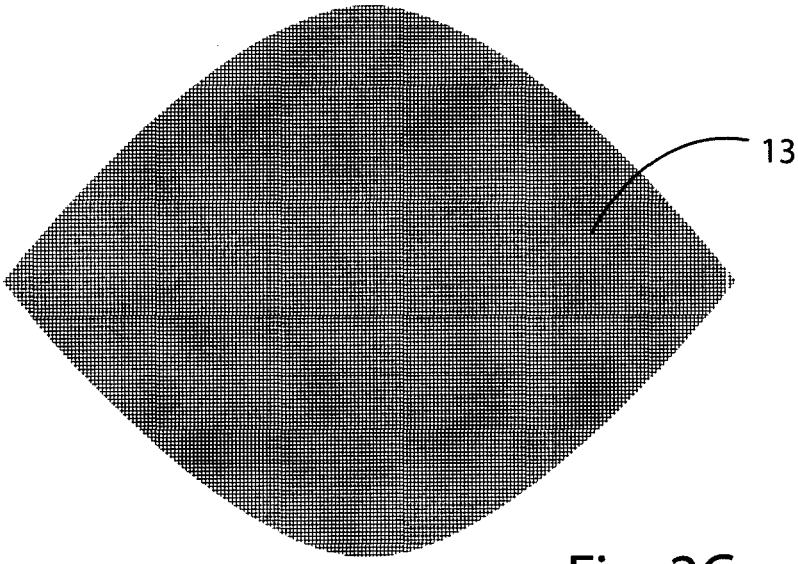
Figure 2D:
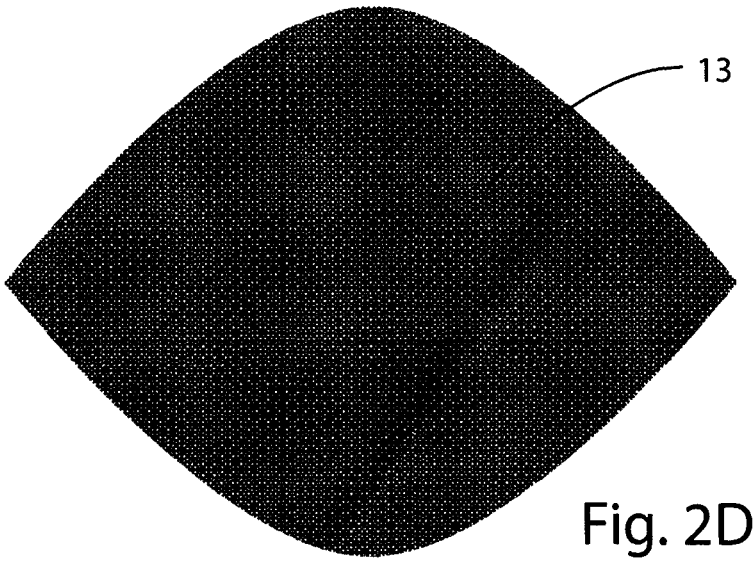

The invention concerns also a process for the production of said abrasive sponge.

19 Claims, 2 Drawing Sheets

(56) References Cited

U.S. PATENT DOCUMENTS 3,280,517 A * 10/1966 Copeland ..... A47L 17/08 15/229.12
3,324,609 A * 6/1967 Stein ..... A47L 17/08 156/148
3,431,689 A * 3/1969 Schnabel ..... B24D 15/04 451/532
3,581,447 A * 6/1971 Falivene ..... C11D 17/049 15/104.93
3,822,517 A * 7/1974 Moss ..... B24D 13/00 15/118
3,862,522 A * 1/1975 Mednick ..... A47L 17/08 15/118
4,360,554 A * 11/1982 Campbell ..... B32B 5/06 428/359
4,477,938 A * 10/1984 Rogut ..... A47L 17/08 15/118
2004/0235406 A1* 11/2004 Duescher ..... C09K 3/1436 451/527
2009/0110890 A1 4/2009 Garza et al.
2010/0257685 A1 10/2010 Tuman

OTHER PUBLICATIONS

International Search Report for PCT/IT2013/000359 dated Jun. 4, 2014.

* cited by examiner

ABRASIVE SPONGE AND PROCESS FOR PRODUCTION THEREOF

CROSS-REFERENCE TO RELATED APPLICATIONS

This application is a National Stage entry of International Application No. PCT/IT2013/000359, filed Dec. 20, 2013, which claims priority to Italian Patent Application No. RM2012A000652, filed Dec. 20, 2012. The disclosures of the prior applications are hereby incorporated in their entirety by reference.

The present invention concerns an abrasive sponge and a process for production thereof.

More specifically, the invention concerns an abrasive sponge with improved cleaning ability.

As well known, by the term sponge it is generally indicated a wide range of products for the cleaning of people or objects, in particular plates, dishes or other household items that are washed frequently. Historically obtained by drying and special treatment of the skeleton of some species of aquatic organisms of the same name, today the majority of sponges are made artificially, and are made up of flexible plastic foam material. In particular, the materials of sponges of vegetable origin may be cellulose-based, those of animal origin are the so-called marine sponges and those of synthetic origin are generally in polyurethane, polyether, or polyester.

In all cases, a common capability to the natural or artificial material at the base of all the sponges is its ability to absorb significant amounts of water and other liquid substances, due to its porous structure.

In the following description, this capacity will be indicated with the term sponginess and such material will be indicated with the term spongy material. The term sponge instead indicates the article made by said spongy material.

A particular type of sponges are the abrasive sponges, which are made of natural or synthetic spongy material and are provided on at least one side of a layer of abrasive material covering the surface of the spongy material, said abrasive layer being generally made of abrasive fibers. The spongy material performs the function of liquid absorption and the abrasive layer coupled thereto performs the function of the abrasive removal of dirt.

More in particular, a spongy synthetic material suitable for the production of abrasive sponges can be chosen by way of example between polyester, polyether or polyurethane, while a spongy material can be for example the natural cellulose.

As to the layer of abrasive material, this can be constituted, in addition to the already said abrasive fibers, for example by abrasive powders, applied to the foam material in various ways.

Also, in general, the coupling between the abrasive layer and the spongy material can be achieved by flaming or by glueing.

According to the prior art, therefore, in the realization of an abrasive sponge two more or less flexible materials are coupled together.

The cleaning action by the user of the sponge is done by finger pressure on the sponge, the abrasive side of which removes the dirt from the surface to be cleaned. The force exerted by the user is then applied on the dirt to be removed indirectly through the sponge. Since the abrasive sponge is soft and flexible, therefore are the operator's fingers which push the abrasive sponge on the surface to be cleaned. Much of the applied force is lost, then, in the deformation of the sponge, as well as of the finger itself, also not rigid.

In light of the above, it appears evident the need to have an abrasive sponge which facilitates the cleaning of the surfaces, making the action carried out by the operator more efficient with the same effort.

In this context it is included the solution according to the present invention, which aims to provide an abrasive sponge with a specific structure for the localized application of the force exerted by the user, with the purpose to reduce the losses due to the deformability of the materials commonly used for the realization of abrasive sponges according to the prior art.

These and other results are obtained according to the present invention proposing an abrasive sponge in which inside the body in the spongy material, below the surface of at least one of its faces, is applied a plurality of granules of rigid material, then one of the faces of said body of spongy material is covered with a layer of abrasive material or with a thin layer of coating material shaped like a wide-mesh fabric or as a net.

Purpose of the present invention is therefore to provide an abrasive sponge that allows to overcome the limits of the solutions according to the prior art and to obtain the technical results previously described.

Further object of the invention is that said abrasive sponge can be realized with substantially contained costs.

Another object of the invention is to provide an abrasive sponge which is substantially simple, safe and reliable.

It is therefore a first specific object of the present invention an abrasive sponge comprising a layer of spongy material covered on at least one side, by a coating layer for the removal of dirt, wherein, inside said layer of spongy material, a plurality of granules of rigid material are present.

Preferably, according to the invention, said granules of rigid material have a diameter of about 3-5 mm, are about 15-30 mm far from center to center and are inserted inside said layer of spongy material.

Still, always according to the invention, said granules of rigid material are made of polymeric material with melting temperature greater than 90° C., preferably crosslinked polyurethane.

Moreover, according to the present invention, said layer of spongy material and said coating layer are coupled by glueing with a layer of glue with melting temperature greater than 90° C., preferably a polyurethane adhesive flexible after curing.

Preferably, always according to the invention, said polymeric material for the glueing of said layer of spongy material and said coating layer has the same chemical composition of the polymeric material of said granules and still more preferably is polyurethane.

Alternatively, according to the present invention, said coating layer is made of a layer of abrasive material, in particular made of abrasive fibers, or is made of non abrasive material, in particular shaped as a relief structure, in particular made of polyester/polyamide and preferably made of one or more layers of a wide-mesh fabric or of one or more overlapping nets, or again of a flexible support from which a plurality of stems extend, preferably hook-shaped, like the male part of Velcro®, or mushroom-shaped.

It is moreover a second specific object of the present invention a process for the production of an abrasive sponge as previously defined, comprising the following steps:

applying, inside a layer of spongy material, a plurality of drops of a melt polymeric material, waiting for the curing of said polymeric material, applying a layer of glue on the surface of said spongy layer under which said drops of melt polymeric material have been applied, applying a coating layer above said layer of glue, and waiting for the curing/drying of said layer of glue.

In particular, according to the invention, said drops of melt polymeric material are drops of a molten reactive hot melt polyurethane material and said layer of glue is a layer of melt hot melt polyurethane adhesive, flexible after curing.

moreover, according to the invention, after said applying of a coating layer above said layer of glue, a step of curing of said drops of melt polyurethane and/or of said layer of melt polyurethane glue is present.

The present invention will be now described, for illustrative but not limitative purposes, according to its preferred embodiment, with particular reference to certain illustrative examples and to the figures of the accompanying drawings, in which:

FIG. 1 shows a side view of an abrasive sponge according to the present invention, and FIGS. 2A-2D show different types of layers of coating material for the abrasive sponge of FIG. 1.

Referring to the figures, an abrasive sponge according to the present invention is generally indicated by the reference number 10, and is made of a layer of spongy material 11, generally but not necessarily with a parallelepiped shape, inside which a plurality of rigid granules 12 are present, said face of the layer of spongy material being coated with a coating layer 13 (which can alternatively be made of a wide-mesh fabric or of a net or of a non-abrasive material or of an abrasive material as according to the prior art), for the removal of dirt. Said coating layer 13 is applied over the surface of said layer of spongy material 11 by glueing. Said rigid granules 12 are made of a polymeric material whose hardness is such as not to scratch the surfaces to be cleaned, not even the most delicate, such as steel, glass, laminates, teflon, ceramic, chrome. This ensures that the surfaces are not scratched and that the principle of removal of dirt is displacement instead of abrasion (consumption through abrasion of the encrusted dirt).

Specifically, for example, but not limiting of the present invention, the layer of spongy material 11 can be made of polyester foam sponge, the granules can be made of rigid drops 12 or beads of crosslinked polyurethane and the coating layer 13 of a net of polyester/polyamide. In general, the material of the layer of spongy material 11 can be any material selected among those commonly used for the sponges (abrasive and not), and in consideration of the different characteristics of wear resistance, absorption capacity, price. Regarding the rigid granules 12, the melting temperature of the polymeric material with which they are made is important to withstand the conditions of temperature, even higher than 90° C., which can be found in a washing machine, dishwasher or autoclave within which the abrasive sponge 10 of the present invention can be inserted for an eventual washing. Furthermore, with regard to the coating layer 13, the choice of material must be made between those which, for hardness, do not scratch surfaces like glass, stainless steel, aluminum, ceramic, for the cleaning of which the abrasive sponge of the invention could be used. The coating layer 13 is coupled to the layer of spongy material 11 by glueing with a polyurethane glue with melting temperatures greater than 90° C., so that the coupling resistance is adequate for the maintenance of the product, namely the melting temperature of the glue with which the coupling is made is sufficient to withstand the temperature conditions that can be formed in a washing machine, dishwasher or autoclave within which the abrasive sponge 10 of the present invention can be inserted for an eventual washing.

In particular, for example, the rigid granules 12 of crosslinked polyurethane are obtained as a result of the application, within the layer of spongy material 11, of drops of molten polyurethane. Subsequent to curing, through which the granules 12 of polyurethane take the necessary rigidity, on the face of the layer of spongy material 11, below the surface of which the rigid granules 12 have been previously applied, the coating layer 13 is applied, by means of glueing, made of a net of polyester/polyamide.

According to a particularly preferred embodiment of the present invention, the rigid granules 12 have a diameter of about 3-5 mm and are about 15 mm far from center to center. Even more preferably, said granules 12 are inside said rigid layer of spongy material.

The result is an abrasive sponge 10 comprising a soft part, represented by the layer of spongy material 11, which acts as the absorbent part, a plurality of rigid granules 12, on which the user's fingers will push for applying the force on the surface to be cleaned, and a part for the removal of dirt, made of the coating layer 13 or by a layer of abrasive material of known type. In this way, the dispersion of the applied force will be very low and therefore the cleaning result will be better, in less time with the same effort. In fact, through the abrasive sponge 10 according to the present invention, it is guaranteed a result of superior cleaning, thanks to the strong mechanical action guaranteed by the presence of rigid granules 12, the need to use abrasive fibers being derogated in favor of a coating layer 13 shaped as a wide-mesh fabric or a net, or even a part of the surface type the "male" of Velcro®, from which a plurality of stems extend conformed as a hook, or alternatively as a mushroom, in each case in the material (as most preferred polyester/polyamide) which can not scratch the surfaces to be cleaned, not even the most delicate, such as steel, glass, laminates, teflon, ceramic, chrome. This ensures that the surface is not scratched and that the principle of removal of dirt is displacement instead of abrasion (consumption through abrasion of the encrusted dirt).

In particular, the coating layer 13 may have different characteristics of stiffness, thickness, mesh size, depending on the result in terms of abrasive capacity to be obtained.

For example, a rigid net with large mesh is very suitable for deep cleaning works with stubborn dirt (scale), while a semi rigid net with medium mesh is more suitable in the case of dirt from food with not strong scale, and a soft net with little mesh is more suitable for cleaning from soiling such as soap scum, toothpaste, or light dirt of food type.

The application of the drops of melt polymeric material (which constitute the rigid granules 12 after curing) below the surface of a face of the layer of spongy material 11 is made with a specific equipment, which will be described below. This equipment can work on plates of spongy material of variable thickness (10-50 mm), depending on the final application of the abrasive sponge made, and of variable width, conveniently equal to 60 cm.

In particular, said equipment for the application of drops of polymeric material consists of:

a station of melting of the polymeric material (polyurethane-based glue), and a pneumatic gun at high temperatures having a plurality of equally spaced nozzles/needles, for the formation of drops of polymeric material just under the surface of a face of the sheet of spongy material.

Subsequent to the curing of the polymeric material of the drops, which requires a rest period variable depending on the polymer used, the temperature and humidity of the environment, the semi-finished product passes to another equipment that has the task to realize the coupling of the coating layer (polyester mesh) or the layer of abrasive material on the plate of spongy material and that is composed of:

a station of melting of the glue used for the coupling, a cylinder for spreading of the melt glue, a device of application of the coating layer of abrasive material on the layer of glue applied on the plate of spongy material, and pressing rollers.

Finally, for the cutting of the sponges, it is used a third cutting equipment with blade or hollow punch technology, which ensures an optimum result on the spongy material and on the net coating. In fact, during the preceding steps on the plates of spongy material a continuous coating layer was coupled, of such a size to couple together the various plates. So the plates, also if they are separated about four inches apart, are united by the coating layer that is continuous. It is therefore necessary to separate the plates to allow the storage. Subsequently, from each individual plate, the individual sponges will be cut and packaged.

EXAMPLE

An abrasive sponge according to the present invention has been realized starting from a spongy material based on polyester, below the surface of which spherical drops were applied of a polyurethane reactive hot-melt adhesive. In particular DUDITERM PU PS 211/10 (produced by Durante & Vivan Ghirano di Prata, PN, Italy) was used, polyurethane hot-melt adhesive (HMPUR: Hot Melt Poly Urethane) 100% solid, immediate grip and chemical curing in 48 hours (23° C. and 55% RH), product with high speed and rigid after curing.

The adhesive was applied in drops, under the surface of the spongy material, at a temperature of 135-140° C. by means of the applicator nozzle, creating the desired roughness on the surface of the sponge.

For further processing it was necessary to wait for the material of the granules resulting from drops of adhesive to be fully cured. For this reason, the material was stored for 48 hours in an environment with a temperature higher than +8° C. and with RH>30% (ideal conditions are 23° C. and 55% RH).

Subsequently, on the basis constituted by the spongy material and from the granules of crosslinked material was applied, in the absence of oxygen, a layer of DUDITERM PU PS 211/16 (of Durante & Vivan), of hot-melt polyurethane adhesive (HMPUR) 100% solid, with immediate grip and chemical curing in 48 hours (23° C. and 55% RH), product with high tackiness and flexible after curing, applied at 140° C. by means of cylinder coating. A thin coating layer, made of a polyester fabric that has been calendared immediately on the layer of adhesive.

The finished product, before further processing was stored for 3/5 days at an ambient temperature higher than 8° C. and relative humidity>30% (ideally 23° C. and 55% RH).

Finally, the product was cut and divided into sponges of the desired size using a cutter blade or a hollow punch. In any case, the cut must follow edges of the arrangement of granules, so as to avoid cutting even the granules.

The present invention has been described for illustrative but not limitative purposes, according to its preferred embodiments, but it is understood that variations and/or modifications may be made by those skilled in the art without departing from the relevant scope of protection, as defined by the appended claims.

The invention claimed is:

1. A sponge (10) comprising a layer of spongy material (11), the layer of spongy material (11) comprising two sides, each side being provided with a respective surface, the layer of spongy material (11) being covered, on at least one side, by a coating layer (13) for the removal of dirt, wherein inside said layer of spongy material (11), in the vicinity of the surface of the side covered with said coating layer (13) and in any case below such surface, a plurality of granules (12) of rigid material are present.

2. The sponge (10) according to claim 1, wherein said granules (12) of rigid material have a diameter of about 3-5 mm, are about 15 mm far from center to center and are about 3-5 mm far from the surface of the side covered with said coating layer (13) of said layer of spongy material (11).

3. The sponge (10) according to claim 1, wherein said granules (12) of rigid material are made of polymeric material with melting temperature greater than 90° C.

4. The sponge (10) according to claim 3, wherein said polymeric material is crosslinked polyurethane.

5. The sponge (10) according to claim 1, wherein said layer of spongy material (11) and said coating layer (13) are coupled together by glueing with a layer of glue, the melting temperature of the glue being greater than 90° C.

6. The sponge (10) according to claim 5, wherein said glue is a polyurethane adhesive flexible after curing.

7. The sponge (10) according to claim 1, wherein said coating layer (13) is made of abrasive material.

8. The sponge (10) according to claim 1, wherein said coating layer (13) is made of abrasive fibers.

9. The sponge (10) according to claim 1, wherein said coating layer (13) is made of non abrasive material.

10. The sponge (10) according to claim 9, wherein said coating layer (13) is shaped as a relief structure.

11. The sponge (10) according to claim 9, wherein said coating layer (13) is made of polyester/polyamide.

12. The sponge (10) according to claim 9, wherein said coating layer (13) is made of one or more layers of a wide-mesh fabric.

13. The sponge (10) according to claim 9, wherein said coating layer (13) is made of one or more overlapping nets.

14. The sponge (10) according to claim 9, wherein said coating layer (13) is made of a flexible support from which a plurality of stems extend.

15. The sponge (10) according to claim 14, wherein said stems are shaped as a hook.

16. The sponge (10) according to claim 14, wherein said stems are shaped as a mushroom.

17. A process for manufacturing a sponge (10), the process comprising the following steps:

providing the sponge (10) with a layer of spongy material (11), the layer of spongy material (11) comprising two sides, each side being provided with a respective surface applying, inside the layer of spongy material (11), under the surface of at least one of the sides of the layer of spongy material (11), a plurality of drops of a polymeric material, the polymeric material being melt, waiting for the curing of said polymeric material, applying a layer of glue on the surface of said at least one of the sides of the layer of spongy material (11) under which said drops of a polymeric material have been applied, applying a coating layer above said layer of glue, and waiting for the curing/drying of said layer of glue.

18. The process according to claim 17, wherein said drops of polymeric material are drops of a molten reactive hot melt polyurethane material.

19. The process according to claim 17, wherein said layer of glue is a layer of molten hot melt polyurethane adhesive, flexible after curing.

* * * * *